United States Patent [19]

Guigan

[11] 4,134,168

[45] Jan. 16, 1979

[54] HOSPITAL BED

[76] Inventor: Jean Guigan, 9, rue Jean Mermoz, 75008 Paris, France

[21] Appl. No.: 878,648

[22] Filed: Feb. 17, 1978

[30] Foreign Application Priority Data

Feb. 24, 1977 [FR] France ..... 77 05430

[51] Int. Cl.[2] ..... A47C 27/08; A61G 07/02

[52] U.S. Cl. ..... 5/369; 5/351; 128/33

[58] Field of Search ..... 5/60, 91, 345, 365, 5/351, 369, 370; 297/284, 452

[56] References Cited

U.S. PATENT DOCUMENTS

| | | | |
|---|---|---|---|
| 3,529,306 | 9/1970 | Thorne | 5/345 R |
| 3,919,730 | 11/1975 | Regan | 5/369 |
| 3,982,786 | 9/1976 | Burgin | 297/284 |
| 3,999,234 | 12/1976 | Regan | 5/351 |

*Primary Examiner*—Casmir A. Nunberg

*Attorney, Agent, or Firm*—Sughrue, Rothwell, Mion, Zinn and Macpeak

[57] ABSTRACT

The hospital bed includes a tank which is partially filled with a liquid or a gel. A plurality of juxtaposed individual floats are disposed in the tank and each float is surmounted by a support. The floats are restricted to substantially vertical movements and the set of supports therefore defines a substantially continuous patient-supporting surface which applies a substantially uniform supporting thrust distributed over the entire lower surface of the patient.

10 Claims, 3 Drawing Figures

HOSPITAL BED

FIELD OF THE INVENTION

The present invention relates to a hospital bed intended in particular for patients who are bed-ridden for a long time and who are liable to suffer from bedsores.

BACKGROUND OF THE INVENTION

Bedsores are attributed to bad circulation of the blood in those parts of the body which press hardest against the mattress of the bed since the patient's weight is not evenly supported by his body. Attempts have therefore been made to produce beds such that the pressure of the mattress is exerted over the greatest possible area of the body and is at all points less than a threshold value which corresponds substantially to the lymph flow pressure.

It has also been observed that the muscles of the body are more completely relaxed when the body is immersed in a liquid. Therefore a bed has been proposed which comprises a tank which is partially filled with a liquid, for example water, the patient being separated from the liquid by a water-tight cloth cover which is sufficiently flexible to take up the shape of his body. "Water beds" of this kind have several disadvantages. Firstly, it should remembered that an adult floats in water in the lying position when the greater part of the body is sunk below the surface of the water. In a water bed, in which an attempt is made to reproduce the preceding conditions, it is clear that the patient will have the disagreable impression of being trapped in the cover which surrounds him. Further, air cannot flow freely between the patient and the cover which results in difficulties concerned firstly with the provision of sterile surroundings and secondly with easy heating of the patient.

Preferred embodiments of the present invention avoid these disadvantages.

SUMMARY OF THE INVENTION

The present invention provides a hospital bed comprising a tank which is partially filled with a liquid or a gel with a plurality of juxtaposed individual floats each surmounted by a support disposed in the tank, said floats being restricted to substantially vertical movement and the set of supports defining a substantially continuous bearing surface in the rest position. Said bearing surface is advantageously covered by a cloth loosely fixed so as never to be pulled taut or stretched when the patient is lying on it.

The supports which surmount the floats have bearing surfaces of a few square centimetres and the floats sink into the liquid so that the supports take up the natural shape of the body. Because of the thrust generated by the liquid or gel, the patient is supported as if he was floating without being enveloped in a liquid or gel cushion; a bed in accordance with the invention therefore provides greater comfort than do usual water beds.

Also, the intermediate space situated between the upper surfaces of the floats and the actual bearing surface makes it possible to provide a flow beneath the patient of air with regulated temperature and humidity. It is even possible to use a gas containing cicatrizing or antiseptic agents.

In accordance with one particular embodiment, the floats are so disposed in the tank that they have little side play so that each of them is guided in its vertical movement by the faces of the adjacent floats. The transverse cross-section of the floats can then be circular or polygonal.

In accordance with another embodiment, the floats are guided vertically in the cells of a rigid honeycomb structure disposed in the tank.

In accordance with an improved embodiment, the support surmounting each float comprises a rod situated in the aforementioned intermediate space and which slides in a liquid-tight manner through an intermediate partition which isolates the patient completely from the liquid or gel.

The tank can have vertical partitions which define compartments which are suitable for containing liquids of different densities and which correspond to parts of the body of different densities, such as the head, the trunk and the legs.

The invention will be better understood from the following description of two embodiments given by way of example with reference to the accompanying drawings.

DESCRIPTION OF THE PREFERRED EMBODIMENTS

Figure 1:
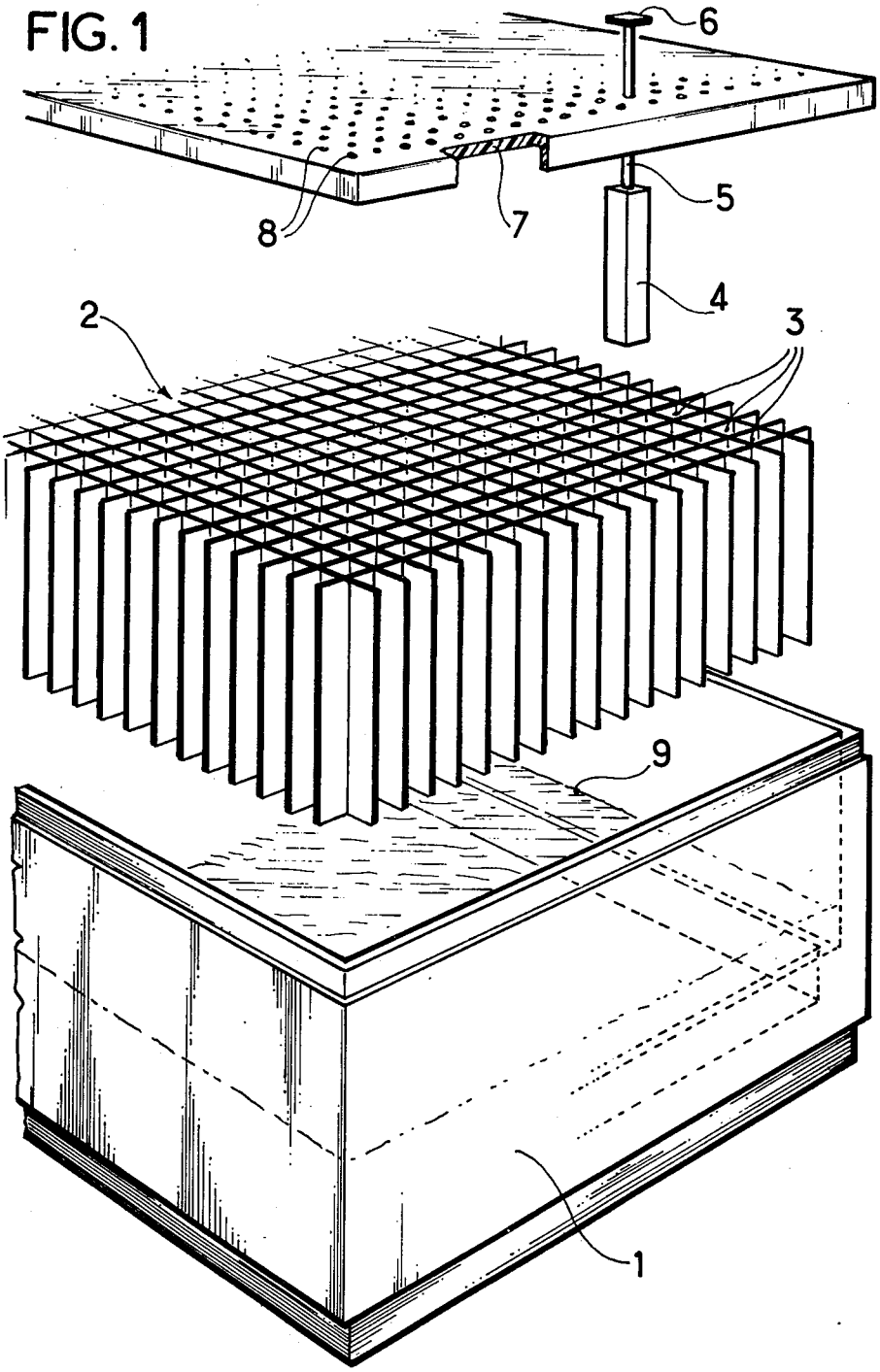
FIG. 1 is a very schematic, partially exploded perspective view of a hospital bed in accordance with the invention.

FIG. 1 shows a tank 1 which is partially filled with liquid and in which there is disposed a honeycomb type of structure 2 which has cells 3. The structure 2 which is preferably made of a plastics material may be unitary or may be constituted by several juxtaposed modules. The cells intercommunicate at their bases, either because the structure 2 is not in contact with the bottom of the tank 1 or because the cell walls are perforated. Each cell is intended to guide a hollow or solid float 4, made for example of a low-density plastics material; this float is surmounted by a support which comprises a rod 5 connected to a bearing surface 6. The rod 5 can slide in a liquid-tight manner in openings 8 in a horizontal intermediate partition 7.

Figure 2:
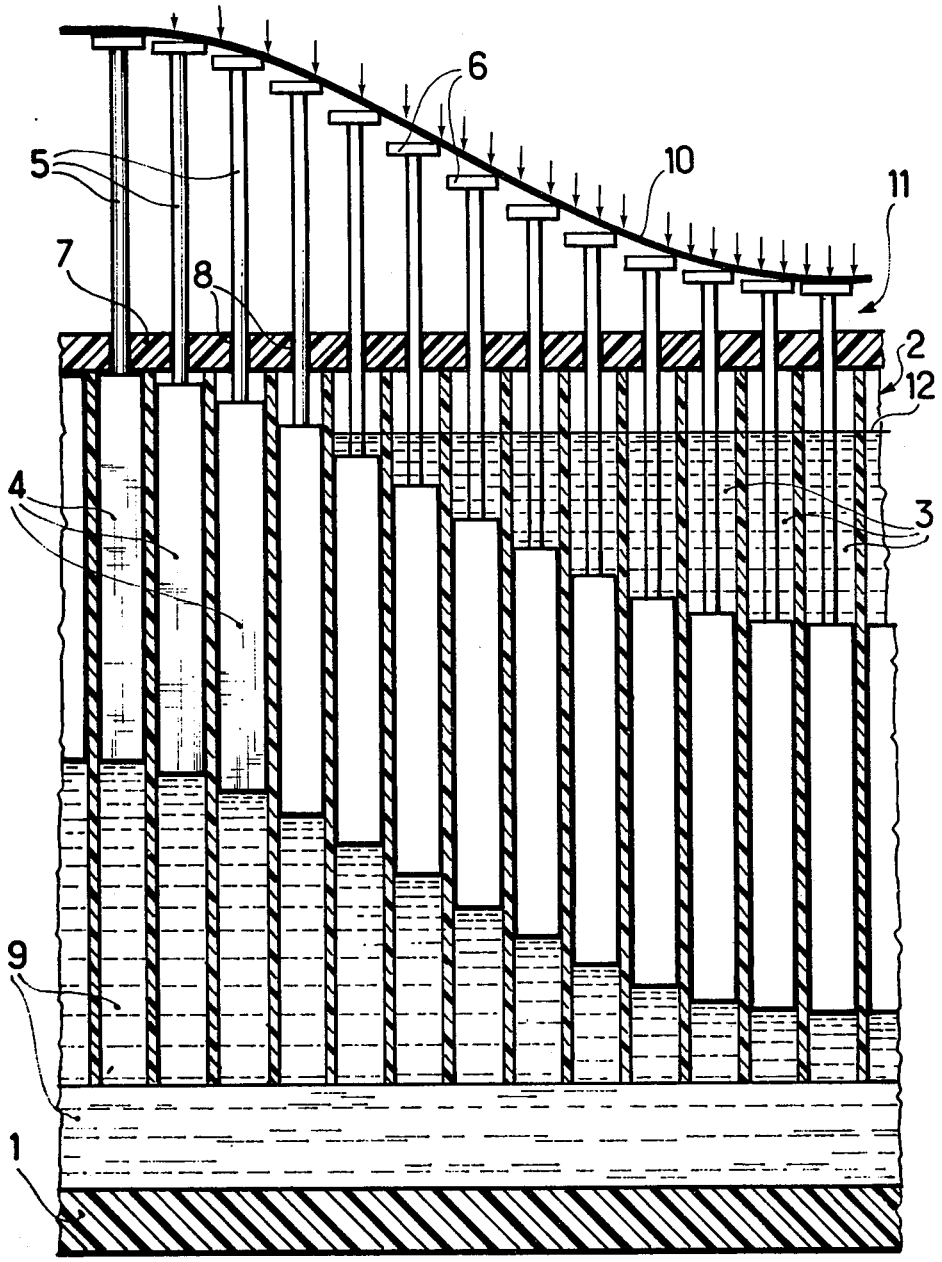
FIG. 2 is a very schematic cross-section veiw of a bed in accordance with the invention in a working position, the patient not being shown.

As can be imagined on looking at FIG. 2, when nothing rests on the bed the upper surfaces of the floats 4 abut against the intermediate partition 7 and the bearing surfaces 6 define a substantially continuous horizontal surface. A cloth 10 which is permeable to gas and to liquids rests loosely on the surface 6 so as not to exert any tension on the patient. When the patient lies on the cloth 10, the floats 4 sink into the liquid 9 down to an equilibrium position (shown in FIG. 2) in which the cloth 10 takes up the natural shape of the body. The water level is indicated by the reference 12.

The intermediate space 11 situated between the cloth 10 and the partition 7 allows the patient's skin to be ventilated and hence improves hygiene; a heating system may be provided there.

By way of example, the floats 4 are about 15 to 25 centimeters high, while the rods 5 are about 10 to 15 centimeters high. The floats 4 and the corresponding cells are shown with square transverse cross-sections, but any other cross-section can be envisaged.

Figure 3:
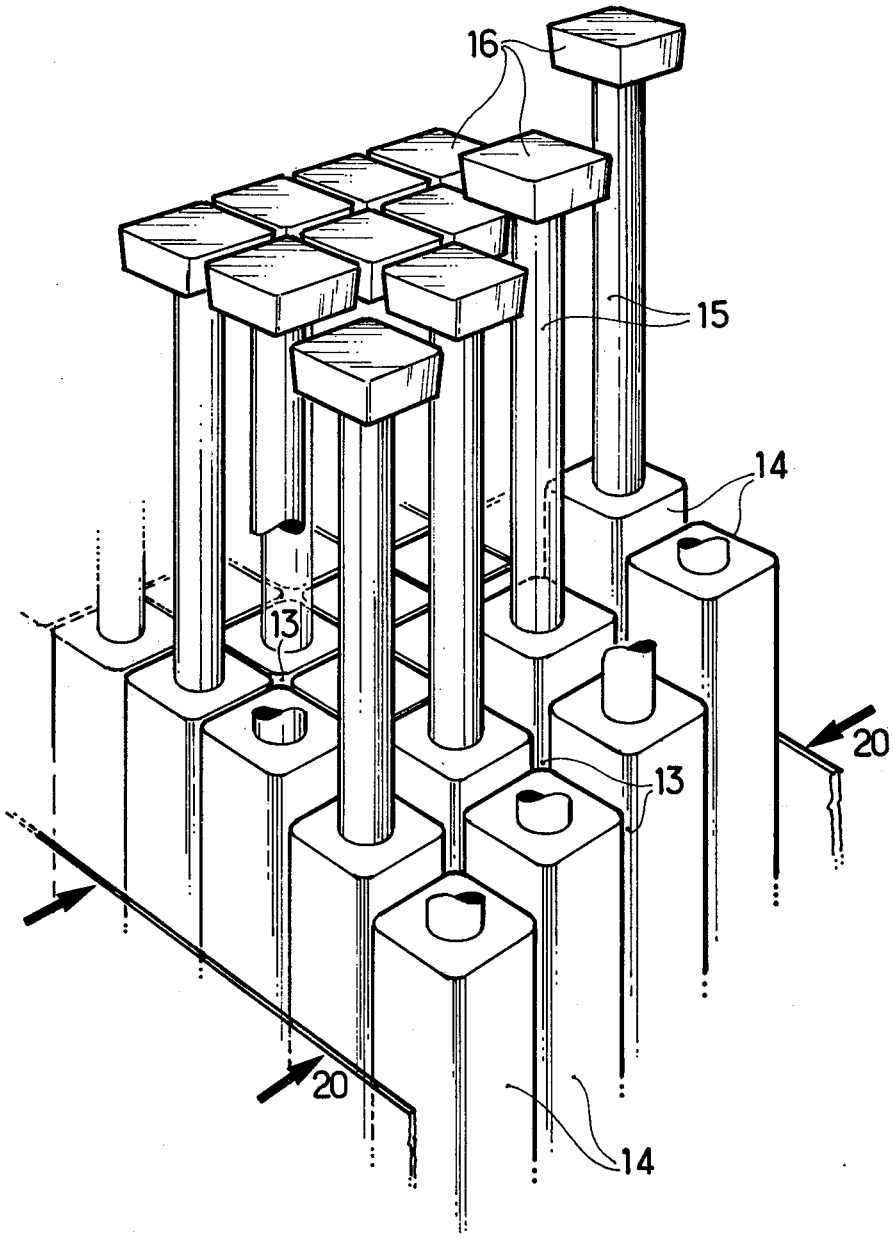
FIG. 3 is a schematic view of another embodiment of the invention including a float and of the support which is integral therewith.

FIG. 3 shows floats 14 which are simply juxtaposed in the tank 1 with a clearance such that they guide one another mutually along their side walls. They have chamfered edges leaving vertical passages 13 through which the liquid 9 can flow. The bearing surfaces 16 are connected to the floats 14 by rods 15.

In a development of the invention means are provided for fixing the floats 14. These fixing means may be constituted by a press shown schematically at 20. It jams the floats 14 together thereby locking the supports 16 in position. It may affect all the floats of the bed or merely the floats of a particular region thereof. Rapid fixing the bearing surface provides the firm support needed for reexamination activities, such as cardiac massage for example to be performed on a patient.

It must be understood that the invention is not limited to the very diagrammatic example which has just been described. Without going beyond the scope of the invention, any means can be replaced by equivalent means.

What I claim is:

1. A hospital bed comprising a tank, a liquid partially filling said tank, a plurality of juxtaposed, individual floats disposed within said tank with their lower ends contacting said liquid for immersion therein, and said liquid being free to circulate between the individual floats, each float being surmounted by a support and forming with the other floats a set of supports, means for restricting said floats to substantially vertical movement; whereby said set of supports define a substantially continuous horizontal bearing surface in the rest position.

2. A hospital bed according to claim 1, wherein said bearing surface is covered by a loosely fixed cloth.

3. A hospital bed according to claim 1, wherein said supports intermediate said floats and said bearing surface are of reduced cross section to form an intermediate space situated between the upper surfaces of said floats and said bearing surface which acts as an air conditioning circuit for providing a flow of air of regulated temperature and humidity.

4. A hospital bed according to claim 1, wherein the sides of said floats abut each other such that each float is guided in its vertical movement by the faces of the adjacent floats.

5. A hospital bed according to claim 4, wherein the transverse cross-section of each float is polygonal.

6. A hospital bed according to claim 4, wherein the transverse cross-section of each float is circular.

7. A hospital bed according to claim 1, further comprising a rigid honeycomb structure defining adjacent cells for guiding said floats vertically in the honeycomb structure cells.

8. A hospital bed according to claim 1, wherein said tank is provided with vertical partitions defining compartments which contain liquids of different densities, with said compartments receiving said floats.

9. A hospital bed according to claim 1, further comprising means for fixing the floats in position.

10. A hospital bed according to claim 9, wherein said means for fixing the floats comprising a press for urging the floats against each other.

* * * * *